United States Patent [19]

Forshee

[11] Patent Number: 4,491,076

[45] Date of Patent: Jan. 1, 1985

[54] STACKING CUBE CONSTRUCTION

[75] Inventor: David J. Forshee, Hilton Head Island, S.C.

[73] Assignee: Formall Syn-Trac Systems, Inc., Madison Heights, Mich.

[21] Appl. No.: 395,461

[22] Filed: Jul. 6, 1982

Related U.S. Application Data

[63] Continuation-in-part of Ser. No. 287,920, Jul. 29, 1981, abandoned.

[51] Int. Cl.[3] ..... B65D 19/18

[52] U.S. Cl. ..... 108/53.1; 108/55.1; 108/56.1; 206/319; 206/600

[58] Field of Search ..... 108/53.1, 55.1, 55.3, 108/55.5, 56.1; 410/49; 206/386, 600, 319; 220/4 F; 217/65, 12 R; 52/586, 281

[56] References Cited

U.S. PATENT DOCUMENTS

| | | | |
|---|---|---|---|
| 2,530,481 | 11/1950 | Rawn, Jr. | 220/4 F |
| 2,733,828 | 2/1956 | Averill | 108/56.1 |
| 3,692,201 | 9/1972 | Gardunq | 217/12 R |
| 3,799,382 | 3/1974 | Monroe | 108/56.1 |
| 4,366,905 | 1/1983 | Forshee | 220/4 F |
| 4,403,697 | 9/1983 | Forshee | 108/55.3 |

FOREIGN PATENT DOCUMENTS

| | | | |
|---|---|---|---|
| 2159650 | 6/1972 | Fed. Rep. of Germany | 108/53.1 |
| 2310275 | 12/1976 | France | 206/386 |

*Primary Examiner*—William E. Lyddane
*Assistant Examiner*—Mark W. Binder
*Attorney, Agent, or Firm*—Benjamin W. Colman

[57] ABSTRACT

A plastic rack or cube, for supporting and translating load units therein, having side walls and end walls formed of a plurality of unitary integrally formed molded panel units connected together at lateral tabs and tab receiving sections, the lateral ends of the walls being connected to corner posts and forming a rectilinear cube-type frame open at its top and bottom. A supporting and nesting member is removably attachable to the inner surfaces of the end walls to hold the load units therebetween. The components of the nesting members can be integrally formed and molded in and with the panel units. One or more medial or intermediate wall units can be removably attached transversely to and between side wall or end wall panel units to provide a plurality of chambers for reception of the load units, supplementary nesting members being attachable to these intermediate walls.

47 Claims, 20 Drawing Figures

STACKING CUBE CONSTRUCTION

CROSS-REFERENCE TO RELATED APPLICATION

This application is a continuation in part to an earlier filed U.S. patent application, Ser. No. 287,920, filed July 29, 1981, now abandoned by the applicant, entitled "Plastic Pallet and Rack Structure."

BACKGROUND OF THE INVENTION

The invention relates to a load unit translation rack or cube made entirely of plastic, except for a few metal fasteners, such for example as bolts, washers and nuts (and these may in some instances be made of a suitable plastic material, depending upon the load to be carried). The cube is rectilinear in form, open at its top and bottom.

Heretofore, relatively heavy automotive transmissions, or engine units, or sub-assemblies thereof (hereinafter sometimes called "load units") have generally been carried or translated on steel racks or platforms having legs and upstanding corner posts. The load units have been supported in translation attitude on metal fixtures welded to the platform and restrained against displacement by metal straps or clamping pieces. The racks have been stacked with their legs upon the corner posts of an inferior, next lower rack, one upon the other.

The amount of volumetric space required in loading and stacking these steel platform racks, one upon the other, is considerably greater than that actually required for carrying and supporting the transmission or engine units. Additionally, the tare weight of these steel racks or platforms is such that the gross weight, including the load units, is significantly great.

In automotive manufacturing, engine and transmission assemblies are variable in size and weight, according to the models of automobiles and trucks being built. Variations in size, weight and capacity result in variations in the design of the engine and transmission units, which are among the larger assemblies or sub-assemblies placed in the automobile or truck structure. Additionally, these load units, which are sensitive to physical shock and can withstand very little abuse, are placed in steel racks of various kinds for translation from station to station in the manufacturing process, in shipping areas, and into shipping carriers. The resultant effect of translating such shock-sensitive load units in steel racks is that all too often, damage to a greater or lesser extent ensues to the load units because of the means by which they are racked and translated.

SUMMARY OF THE INVENTION

The plastic translation unit disclosed in the aforementioned U.S. patent application Ser. No. 287,920 provided for a plastic cube or rack having an open top and bottom, integrally formed perimetric side and end walls, connected together at their ends to form corners, and a number of transversely or longitudinally extending load unit-supporting members, secured to and between the side walls or the end walls of the cube.

The construction disclosed in the instant application constitutes an improvement in the cube structure that further reduces costs and provides full support for transmission and engine units without hold-down straps or clamps. That is, transmission units and engine units can be translated in the plastic cube without displacement of the load units and without the necessity of clamping them in place in the cube.

The improved cube structure includes a plurality of plastic panel units rigidly connected in a series to form side walls and end walls which are secured to corner posts by suitable fasteners, such for example as bolts, washers and nuts of metal or plastic, to form a rectilinear rack open at its top and bottom. Load unit supporting and nesting strips are secured to the inner surfaces of the end walls and, in the case of a divided cube, to each side of a transversely disposed medial wall which is attached to the side walls. Stacking caps surmounted to the upper ends of the corner posts permit cubes to be stacked one upon the other, in vertical alignment.

As illustrated in the several views of the drawings, a preferred embodiment of the racks or cubes hereindescribed is shown to carry four load units, such for example as transmission assemblies. However, the cube can be designed for carrying two, six or eight load units, or a different number, depending upon their size and configuration and the dimensional limits of the cube imposed by weight, size and the carrier into which the stacked cubes may be loaded and translated.

As in the case of the cube disclosed in co-pending U.S. patent application Ser. No. 287,920, the racks of this invention are only slightly higher than the load units carried by them, and are stackable, one upon the other, with space loss efficiently eliminated. Thus, the net load carried by multiples of the cubes is significantly greater than that of prior art rack devices known to the applicant. Such space-saving results in higher pay loads for trucks and rail cars.

The invention disclosed herein more directly involves the use of some invertible, exchangable wall panel units in side walls or end walls and in combination with corner panel units to form the cube or rack. The stacked cubes of this invention can be translated by a fork lift truck without the use of an underlying pallet, further reducing the cost of the material handling equipment required. The savings effected by eliminating the pallet becomes significantly great when hundreds (or thousands) of them are no longer needed.

Additional advantages include significantly lower tare weight, color-coding of the plastic panel units for identifying and distinguishing between various models of the load units carried in them for manufacturing, processing, storage and shipping operations, significantly less damage to the load units by virtue of the shock absorption by the plastic cube in contrast with little or no such shock absorption of relatively inflexible steel, the facility of manually handling relatively low weight plastic racks not possible with substantially heavier steel racks, lower maintenance and repair costs, lower costs in conversion of the cubes to handle different sizes and shapes of load units, and additional maintenance benefits and advantages.

BRIEF DESCRIPTION OF THE DRAWINGS

These and other features, objects and advantages of the invention will become more apparent by reference to the following detailed description to be read in context with the attendant drawings.

DESCRIPTION OF A PREFERRED EMBODIMENT

Figure 1:
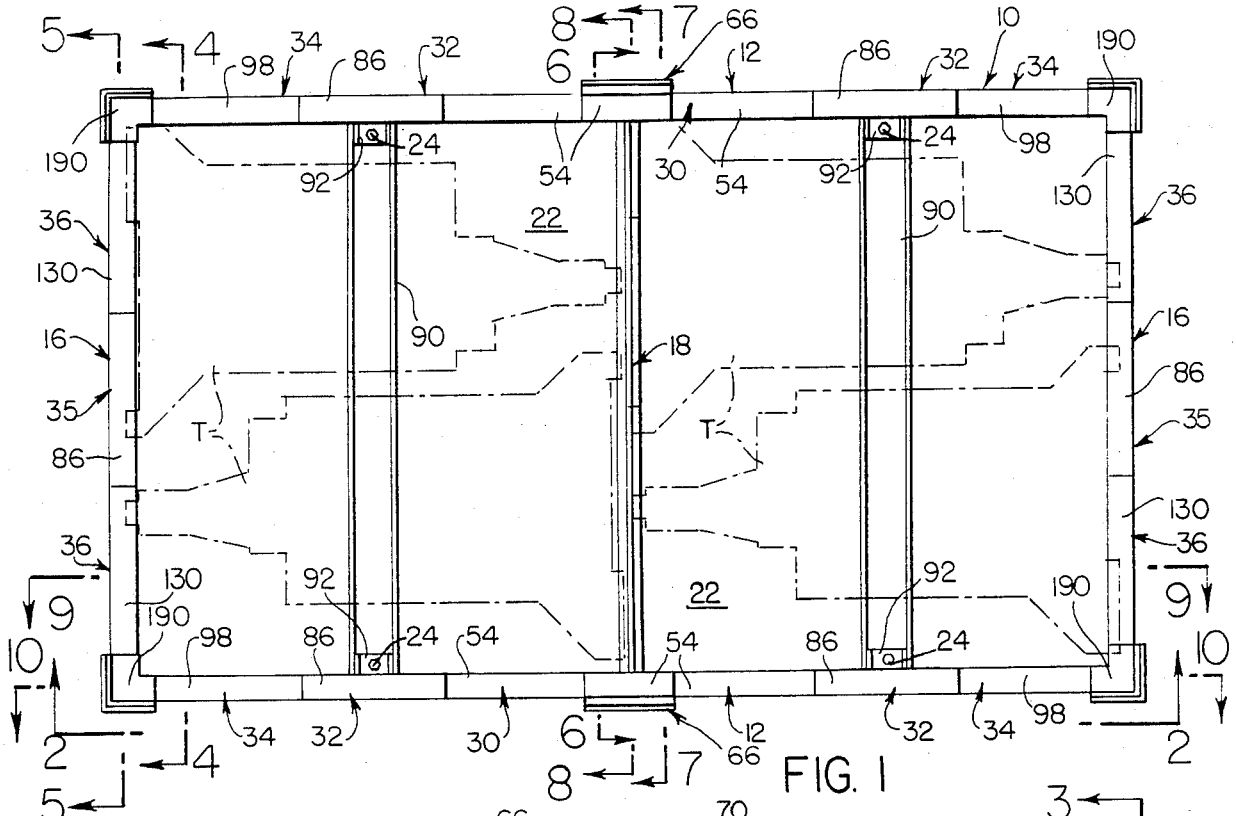
FIG. 1 is a top plan view of a cube, carrying four load units (transmission assemblies) in place, embodying the invention disclosed herein.
Figure 2:
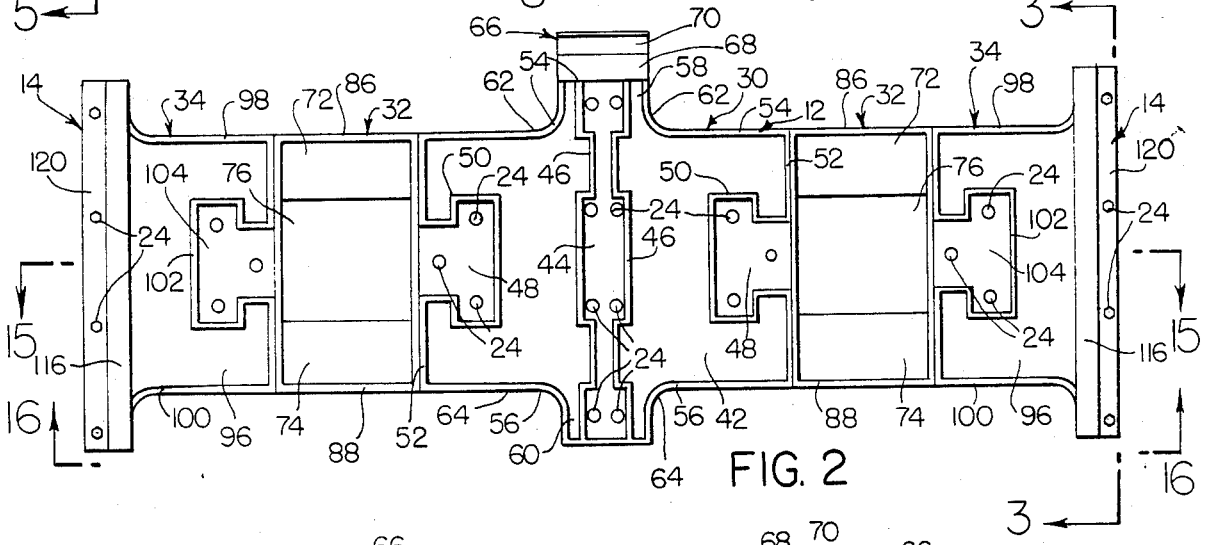
FIG. 2 is a vertical outer side elevational view taken substantially on the line 2—2 of FIG. 1.
Figure 3:
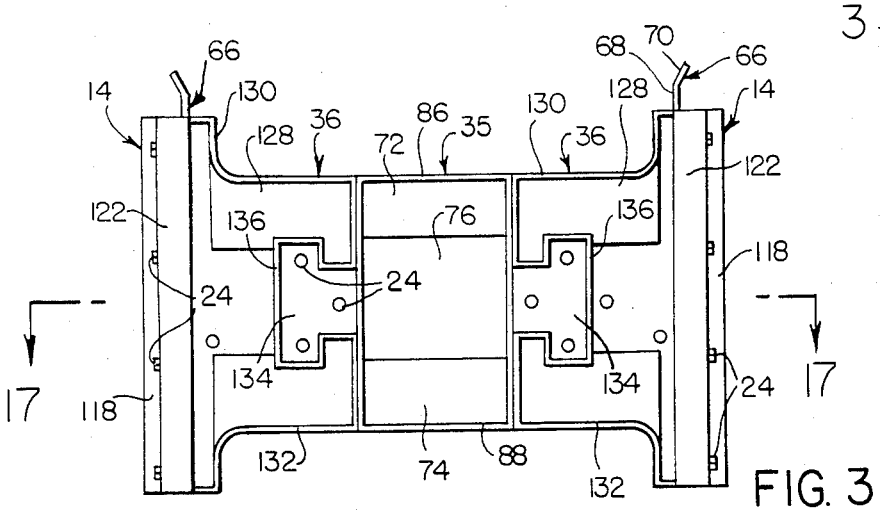
FIG. 3 is a vertical outer end elevational view taken substantially on the line 3—3 of FIG. 2.

A preferred embodiment of the invention is that illustrated in the several views of the drawings and described hereinbelow.

The plastic stackable rack or cube 10 comprises a pair of substantially parallel side walls 12, 12 connected at their lateral ends to corner posts 14, a pair of end walls 16, 16 connected at their lateral ends to the corner posts 14, a transversely disposed medial wall 18 substantially parallel tofhe end walls 16, 16 and connected at its lateral ends to the side-walls 12, 12, and load unit supporting and nesting members 20 removably affixed to the inner surfaces of the end walls and to both sides of the medial wall in facing opposed reversed relationship in each chamber 22 of the cube. The load units T (transmission assemblies) are cradled in and between the nesting members 20 in staggered or reversed relationship in each chamber 22.

The ends of the side walls and end walls are connected to the corner posts in removably fixed relationship by conventional metal fasteners 24, such as bolts, washers and nuts, the nuts preferably being prevailing torque lock nuts. The side walls, end walls and medial wall form a rectangular cube-type frame with two rectangular chambers open at their tops and bottoms.

The cubes 10 are stackable one upon another when loaded and the stack can be translated by fork-lift trucks from one work station to another, or to a storage area, or directly from a production line or storage area into a shipping carrier, without the use of a supporting pallet or platform.

All of the components of the cube 10, except the fasteners 24, are preferably made of a strong durable plastic material, such for example as DuPont's Zytel® ST (super tough) nylon material, produced by the DuPont de Nemours & Co. (Inc.) of Wilmington, Del., as unitary integrally molded wall panels, corner posts and caps, nesting members and fittings therefor. The Zytel® nylon material can be further strengthened or reinforced beyond its normal basic physical properties of high tensile and comprehensive strength, with fiber glass filaments, according to practices well known in the plastic art.

Each side wall 12 comprises a side central panel unit 30, a pair of side intermediate panels 32,32 connected to the side central panel unit at each side thereof, and a pair of side end panels 34,34 connected to the distal ends of the intermediate panels. The side central panel unit, side intermediate panels and the side end panels all lie in a plane.

Each of the end walls 16,16 comprises an end intermediate panel 35, substantially identical to the side intermediate panel 32 except for the absence of the channel-type members 92, and a pair of end-end panels 36,36 substantially similar to the side-end panels 34. The differences in the end panels lie in their outer lateral edges which are attached to the corner posts 14 and in their overall width.

The side central panel unit 30 comprises a panel body 42, having a medial support plate receiving section 44, defined by laterally projecting ribs or flanges 46,46 on both sides of the planar panel body and intermediate panel tab receiving sections 48,48 defined by laterally projecting ribs 50 on each side of the body at each lateral end 52,52. The tab receiving sections 48,48 are slightly offset laterally outwardly so as to receive the ribbed offset tabs of the adjacent side intermediate panels 32,32 thereon and maintain the latter panels in the plane of the body 42 of the side central panel unit 30.

The upper and lower perimetric edges of the side central panel unit 30 are defined by ribs 54,56 respectively, extending laterally outwardly on both sides from the panel body 42. The ribs 54,56 define the upper and lower projections 58,60 respectively adjacent the notches 62,62 and 64,64 respectively at each side of the projections, whereby access is provided for the tines of lift fork trucks to raise and lower the cube. The ribs 54,56 extend about the perimetric upper and lower portions 58,60 respectively and conjoin with the ribs 50,50 defining the tab receiving sections 48,48. The perimetric rib 54 above the projection 58 is provided at its outer lateral edge with a guide lip 66 having an upstanding body portion 68 and an outwardly angled portion 70 thereabove, whereby the lower projection 60 of a superposed cube is guided to rest upon the rib 54 of the cube therebelow in the stacking operation.

Figure 9:
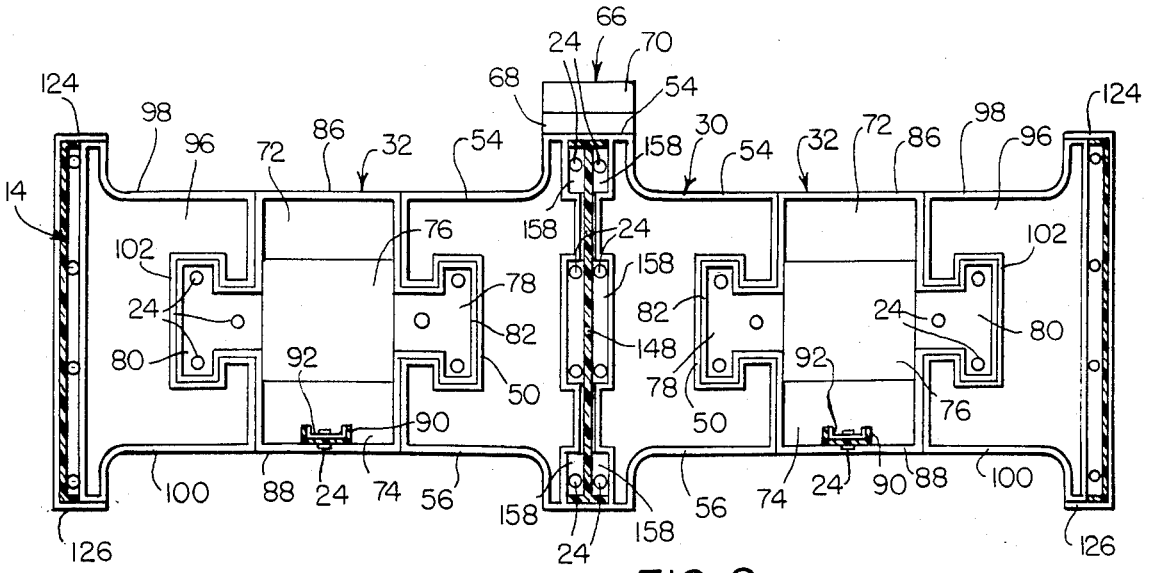
FIG. 9 is a longitudinal vertical inner side elevational view, partially in section, taken substantially on the line 9—9 of FIG. 1.
Figure 10:
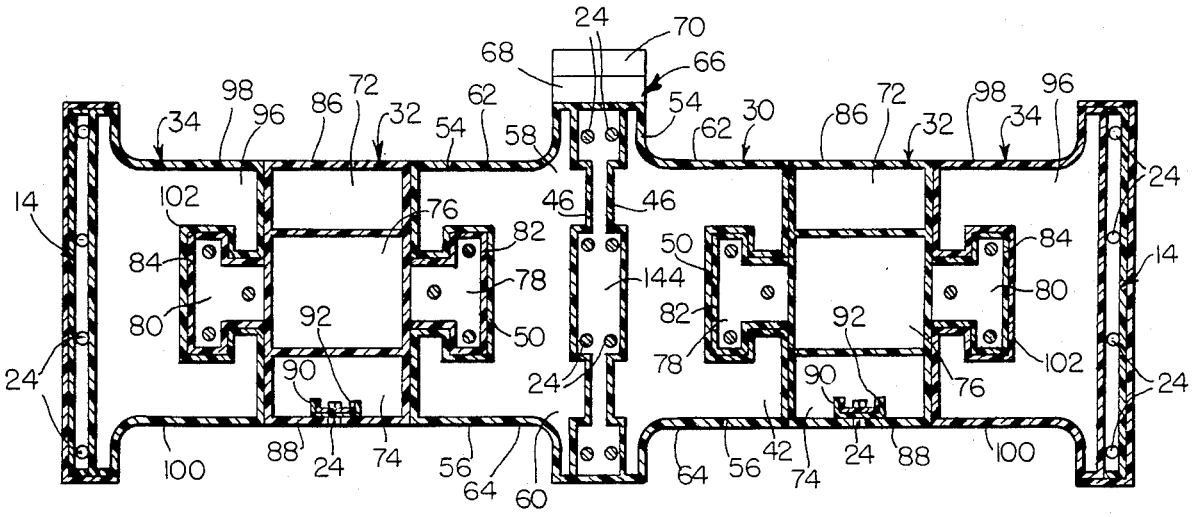
FIG. 10 is a longitudinal vertical sectional view taken substantially on the line 10—10 of FIG. 1.
Figure 11:
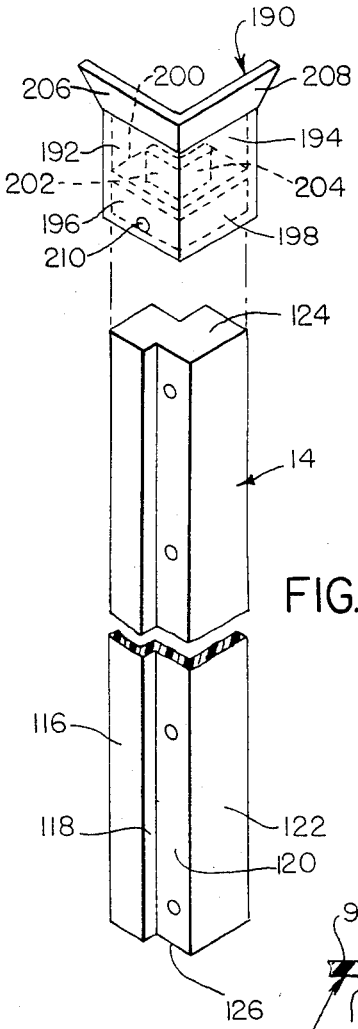
FIG. 11 is a fragmentary perspective view of a corner post and stacking cap in exploded relationship.

The side intermediate panels 32,32 each comprises an upper panel body portion 72, a lower panel body portion 74, an intermediate inwardly offset panel body portion 76, and a pair of oppositely directed laterally offset tabs 78, 80 (FIG. 9) defined by perimetric ribs 82,84 respectively which closely fit within the perimeters of the ribbed tab sections 48,48 at each lateral edge of the side-central panel unit 30. The tabs 78 are secured to the tab sections 48 by fasteners 24 or other suitable means. The upper and lower edges of the panel body portions 72 and 74 respectively are defined by ribs 86,88 respectively extending laterally outwardly on both sides from the body portions.

As shown more particularly in FIGS. 1, 9, 10, 18 and 19, a pair of channel members 90,90 are removably secured to and between opposing side intermediate panel units 32,32 by channel-type bracket members 92 projecting from the inner surface of the panel body portions 74 of the respective intermediate panels 32 and to the distal ends of the channels by fasteners 24. The channel members 90 provide an added measure of security against tipping the cube if the tines of a fork lift truck are projected longitudinally thereunder for lifting the cube when empty, partially or fully loaded. It is possible that, without the channels 90 as a transverse support, the cube could tip over if the tines did not reach under and beyond the far end wall 16 opposite the end wall adjacent the fork lift truck. Normally, the tines will reach transversely of the cube under both side walls 12,12 in the notched areas without difficulty.

As to the side-end panels 34,34, each comprises a panel body 96 defined by upper and lower perimetric ribs or flanges 98,100 respectively conjoined to the rib 102 defining the laterally offset tab receiving section 104 on the inner and outer sides of the panel body. Aligned ribs 102,102 defining the tab receiving sections extend laterally outwardly from each side of the panel body. The distal edges of the side-end panels 34,34 are defined by aligned vertical corner flanges 106,106 on each side of the panel body, and inwardly of the vertical distal edge flange 108 which lies in the plane of the panel body 96. The side-end panels 34 are invertible for use at either end of the side wall 12.

Figure 13:
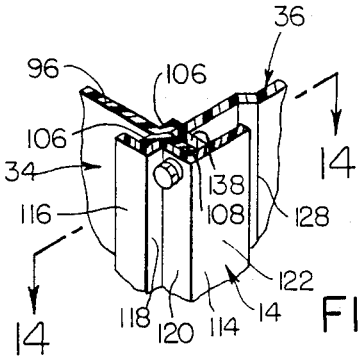
FIG. 13 is a fragmentary perspective view of a corner post and adjacent connected side and end wall panel members.

The corner posts 14 each comprises a body 114 having an end-wall facing flange 116, a right angle panel 118, a second panel 120 offset by the panel 118 but parallel to the flange 116, and a side-wall flange 122 at right angles to the flange 116 and parallel to the panel 118. The side wall end panel 34, when affixed to the corner post body, has its distal edge flange 108 overlying and adjacent to the inner surface of the second panel 120 (FIG. 13). The top and bottom edges of the flanges and panels 116, 118, 120 and 122 are capped by end plates 124,126 respectively.

The end-wall end panels 36,36 are conjoined to and abut each side edge of the end wall intermediate panel unit 35 and, at their distal edges, are conjoined to the corner post flange 120 and in overlying relationship with the sideend panel distal edge flange 108. The end-end panels 36 comprise a panel body 128, upper and lower perimetric flanges or ribs 130,132 respectively, a tab receiving area 134 slightly offset laterally outwardly and defined by laterally inwardly projecting ribs 136, to seat the intermediate panel unit tabs 78,80 and their defining ribs 82,84 respectively therewithin. The end-end panels 36 are invertible for use at either end of the end wall 16.

Figure 14:
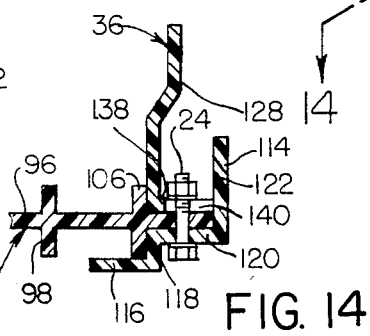
FIG. 14 is a transverse horizontal sectional view taken substantially on the line 14—14 of FIG. 13.
Figure 15:
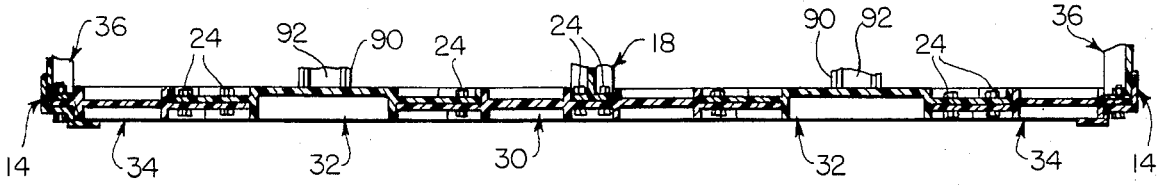
FIGS. 15 and 16 are horizontal sectional and bottom plan views respectively taken substantially on the lines 15—15 and 16—16 respectively of FIG. 2.
Figure 16:
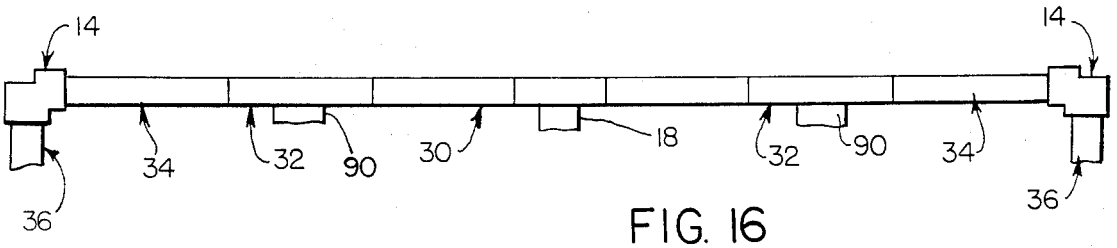
Figure 17:
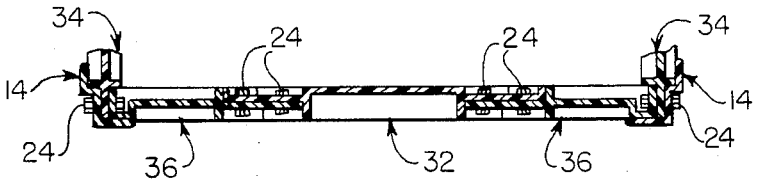
FIG. 17 is a horizontal sectional view taken substantially on the line 17—17 of FIG. 3.
Figure 18:
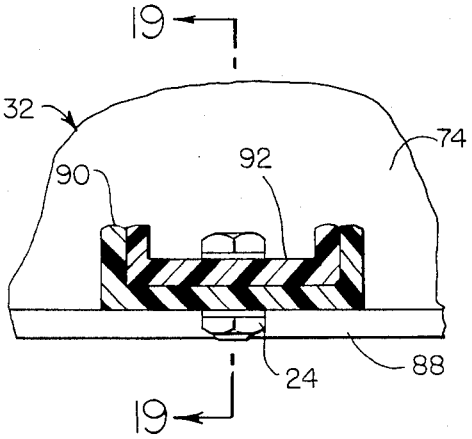
FIG. 18 is a slightly enlarged fragmentary vertical elevational view, partially in section, of the transverse channel and supporting bracket in each of the chambers of the cube.
Figure 19:
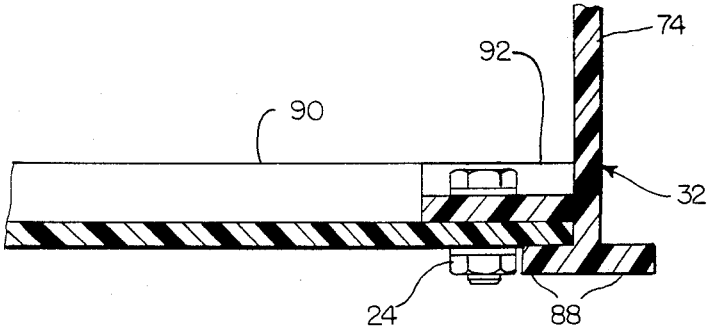
FIG. 19 is a vertical sectional view taken substantially on the 19—19 of FIG. 18.
Figure 20:
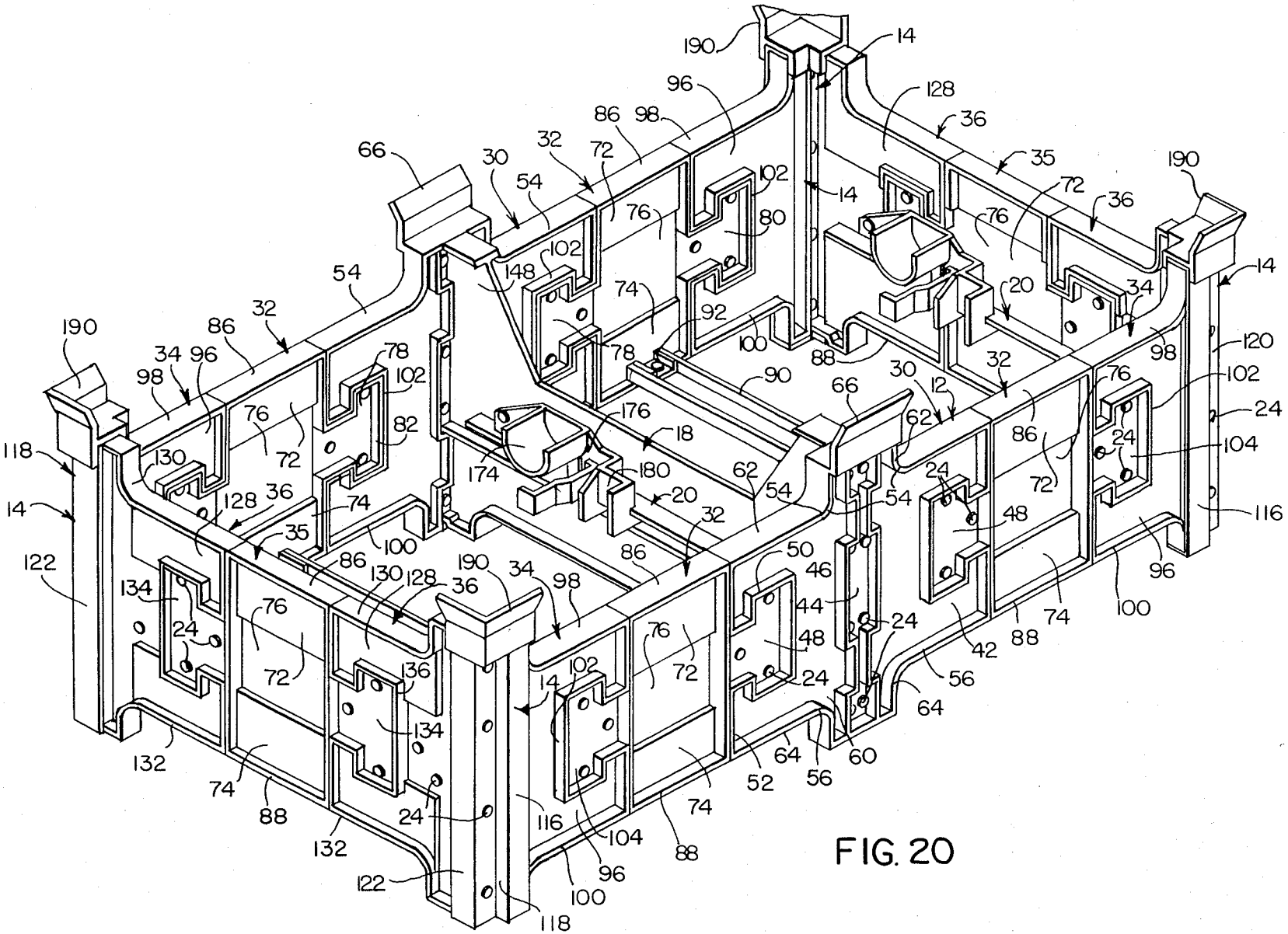
FIG. 20 is a perspective view of the cube illustrated in the foregoing views of the drawings.

The end-end panels 36,36 are substantially similar in structure and dimensions to the side-end panel units 34,34, except that in the embodiment hereindescribed, the panels 36 are slightly wider than the panel units 34 and have a different distal edge. The end-end panel body 128 is slightly offset inwardly adjacent its distal edge and terminates in an outwardly directed right angle flange 138 having transverse slots 140 at its distal edge for reception of the bolts of fasteners 24 that secure the side wall end panel unit 34 and the adjacent end wall end panel unit 36 to the corner post 14 (FIGS. 13 and 14) at right angles to each other.

Figure 8:
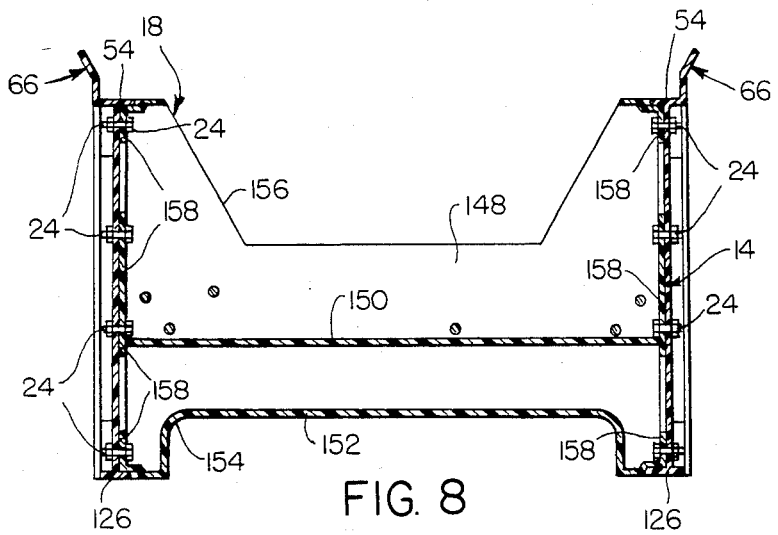
FIG. 8 is a transverse vertical elevational view of the medial wall taken substantially on the line 8—8 of FIG. 1.

The medial load unit support wall 18 (FIG. 8) comprises a panel body 148 having longitudinally extending horizontally aligned and oppositely outwardly directed ribs 150,150 on each side of the panel body 148, a lower flange or rib 152 on each side of the panel body defining a lower notched area 154 for admitting the tines of a fork lift truck thereunder, an upper notched area 156 in the panel body, and a plurality of lateral edge flanges 158, at right angles to the panel body, having edge slots therein to accept the fasteners 24 which secure the medial wall to the side wall central panel unit 30 in the support plate receiving section 44 and within or between the ribs 46,46.

Figure 4:
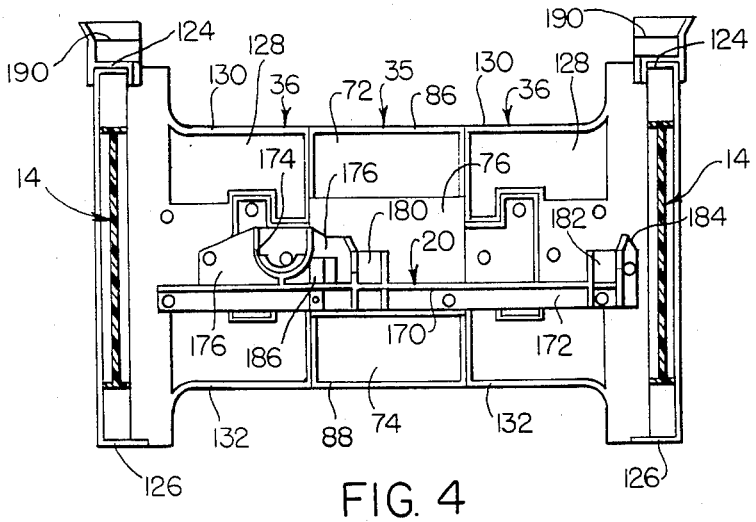
FIG. 4 is a transverse vertical inner end elevational view, partially in section, taken substantially on the line 4—4 of FIG. 1.
Figure 5:
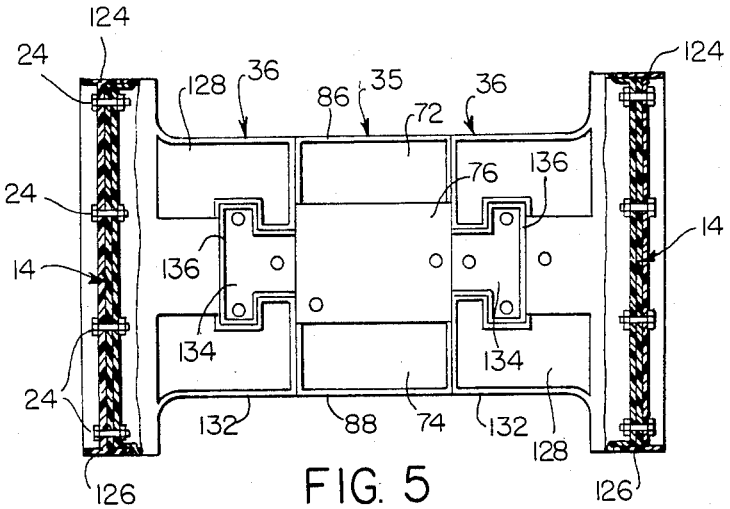
FIG. 5 is a vertical sectional view taken substantially on the line 5—5 of FIG. 1.
Figure 6:
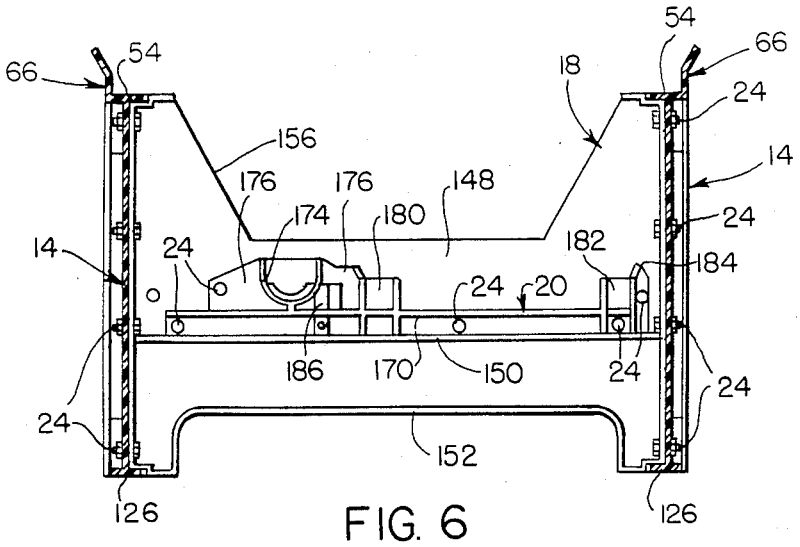
FIGS. 6 and 7 are transverse vertical inner medial elevational views taken substantially on the lines 6—6 and 7—7 respectively of FIG. 1.
Figure 7:
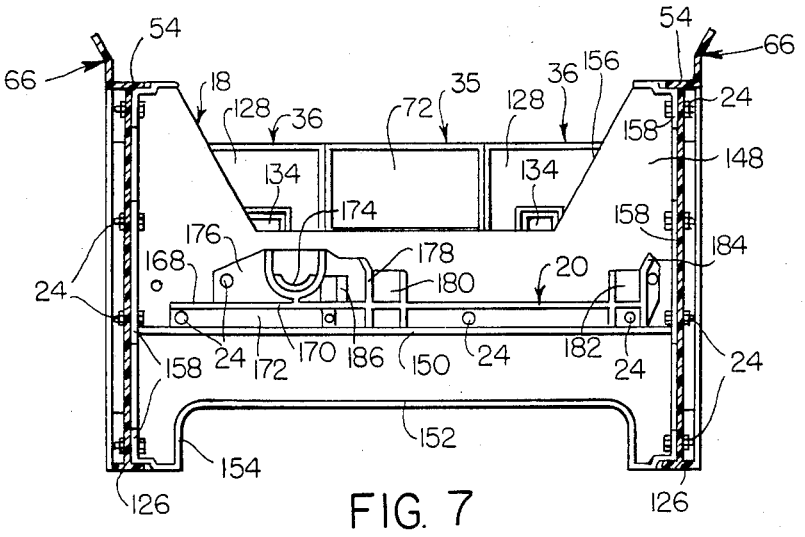
Figure 12:
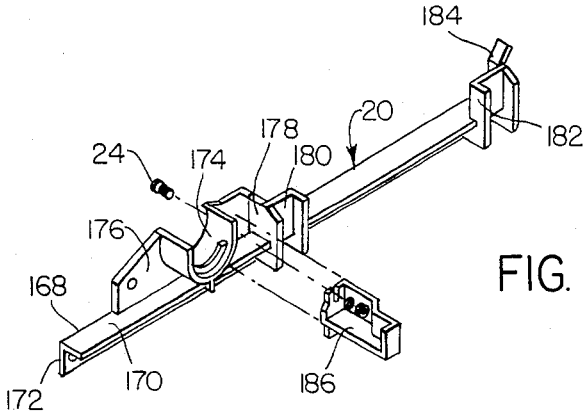
FIG. 12 is a perspective view of a load unit supporting and nesting member and complementary fitting secured to the end walls and the medial wall.

As shown in several views of the drawings and more particularly in FIG. 12, the load unit supporting and nesting members 20 are disposed horizontally above the medial wall ribs 150 (FIG. 6) on each side of the panel body 148 and secured thereto by fasteners 24. The supporting and nesting members are also attached and secured to the inner surfaces of the end walls 16,16 upon the panel units 35, 36,36 (FIG. 4). The members 20 are reversed in attitude at each end of the chambers 22 so that the transmissions T in each chamber, when loaded thereinto are reversed in direction (FIG. 1).

The supporting and retention elements of the nesting members 20 will vary according to the design, configuration and dimensions of the load units which they are designed to support. The elements of the members 20, illustrated in FIG. 12 and in the other views are merely representative of some features that can be used to support and secure load units such as transmission assemblies in the cubes 10. The description and illustrations herein are not to be considered or construed to limit in any way the construction of attachable nesting members that may be required to support and retain load units, of various shapes and sizes, in the cube.

As a representative example only of a load unit supporting and nesting member, the member 20 (FIG. 12) comprises an angle 168 having horizontal and depending legs 170 and 172 respectively, the lower depending leg 172 being secured and attached to each side of the medial wall panel 148 and to the inner surfaces of the end wall panel units 36,35, 36 by fasteners 24, a cradle element 174 for one end of the load unit T mounted on and projecting laterally from a flange member 176, a wall section 178 at one end of the flange member and a laterally offset retention member 180 adjacent the wall section, an aligned laterally offset retention member 182 spaced longitudinally from the member 180 adjacent the other end of the angle 168, and an end bracket or flange 184 to limit lateral displacement of the load unit T at rest and support upon the angle portion between the elements 178 and 184. The retention members 180 and 182 engage flanges on the load units T to limit and prevent longitudinal movement thereof. A separate retention member 186 is attachable to the flange member 176 adjacent the cradle 174 to engage and limit and prevent longitudinal displacement of the load unit T supported at its one end by cradle 174.

Although the nesting members 20 are described herein as being separate components of the cube for attachment to the end walls 16,16 and the medial wall 18, it will of course be understood by persons skilled in the art that the supporting and retention elements of those members can be integrally molded with and in the panel units 35,34,36, allowing for relocation of fasteners to secure the various tabs to the tab supporting receiving areas of adjacent panel units. In some instances it may be economically more feasible to mold the nesting elements in and with the end wall panel units than provide them in the separable nesting component 20. In other cases, where the cube can be used for a number of different size and shape load units, the separable nesting member allows for economic and practical modification of the cube to accommodate the different models. Additionally, the separate and separable nesting member 20 assists in stiffening and rigidifying the end and medial walls when attached thereto.

In some instances it may be more practical to place the load unit supporting and nesting members 20 on the opposing side wall panels in facing relationship, depending on the size and configuration of the load units. Or, the supporting and nesting elements or components of such members can be integrally formed and molded into the side wall panel units.

The stacking corner caps 190 comprise a pair of side walls 192,194 at right angles to each other, skirt portions 196,198 respectively below the capping plate 200 which rests upon the upper end plate 124 of the corner posts 14, and a pair of adjacent skirt portions 202,204 depending from the capping plate opposite the skirt portions 196,198 respectively. The upper edge portions 206,208 of the side walls 192,194 are angled upwardly outwardly to ease entry of a superposed cube 10 into stacked relationship with a lower cube unit. The skirt portion 196 is perforated with an opening 210 to pass a fastener 24 therethrough for securing the cap 190 to the corner post 14.

Although cube 10 as described is formed with two compartments or chambers 22, it will of course be understood that a cube having only a single compartment or more than two compartments can also be made according to the invention disclosed herein.

The tabs 78, 80 and 134 of the intermediate panel units 32 and 35 are illustrated as being rectilinear in shape. Such configuration, however, is not absolutely essential. For instance, the tabs and their respective receiving areas can be arcuate, circular, oval, or any other suitable configuration which enables the related connected panel units to form a relatively rigid side wall or end wall, sufficiently unitary in structure to support and safely translate the load units contained therein without damage and displacement.

The components of the cube 10 are preferably made as unitary integrally formed molded plastic units of the DuPont Zytel® ST nylon material. These components include the side wall panel units 30, 32 and 34, the end wall panel units 35 and 36, the medial wall unit 18, the corner posts 14, the nesting members 20, the retention members 186 and the stacking caps 190. The fasteners 24 are preferably bolts, washers and nuts made of metal.

It will be noted that the upper and lower perimeters of the side walls 12, except for the guide lips 66, and the end walls 16 are substantially identical and that the upper and lower ends of the corner posts 14 are also substantially identical. If the guide lips 66 are made as separable elements removably attachable to either the upper or lower projection 58 or 60 respectively of the side central panel unit, the design permits the cube frame to be used with either end up or down, the principal changes required being inversion of the supporting and nesting members 20 and relocation of the stacking caps 190 on the upstanding end of the corner posts. The inwardly projecting channel-type members 92, if also molded into the upper panel portions 72 or if made as separable bracket members removably attachable to either the upper or lower panel portions 72 or 74 respectively, will make the intermediate panel unit 32 fully invertible.

In this regard, an important advantage of the cube construction is the simplicity, ease and low cost of repairs and maintenance of the cube. If damage occurs to one or more panel units, only those panel units need be replaced. This is simply accomplished by removal of fasteners 24, disassembly of the damaged panel units, replacement and reassembly with new panel units, and reattachment of the fasteners to secure the reassembled panel units into a rigid wall.

The invention provides the positive advantage of having a few limited number of different components for repair and replacement inventory, namely: a side central panel unit 30, a side- or end- intermediate panel unit 32 or 35, a side-end panel unit 34, an end-end panel unit 36, a corner post 14, a stacking cap 190, a medial wall unit 18, a support and nesting member 20, and fasteners 24.

Having disclosed herein a certain particular embodiment of the invention for purposes of explanation, further modifications or variations thereof, after study of this specification, will or may occur or become apparent to persons skilled in the art to which the invention pertains. Reference should be had to the appended claims in determining the scope of the invention.

I claim:

1. In a space saving plastic stacking-type cube or rack combination for handling one or more load units more efficiently to effect a higher payload for in-plant translation or storage and truck, plane or rail car translation comprising a plurality of plastic corner posts, a pair of spaced apart parallel plastic side walls each removably connected at their longitudinal ends to a pair of said plastic corner posts, a pair of spaced apart parallel plastic end walls each removably connected at their longitudinal ends to said pairs of plastic corner posts and forming with said side walls and corner posts a rectilinear frame open at its top and bottom, and a pair of oppositely facing parallel load unit supporting and nesting members removably affixed to the inner surface of each said end wall to support and nest one or more said units therein, the improvement wherein said plastic side walls and end walls each comprises a plurality of plastic panel units removably secured together in a planar series in side-edge to side-edge relationship, at least one said panel unit of said series having tabs at its lateral edges and the next adjacent panel units of said series having tab receiving sections, said tabs being disposed upon said tab receiving sections in overlying back-to-face relationship respectively.

2. The plastic cube or rack defined in claim 1, including a unitary, integrally formed, molded plastic medial wall unit comprising a medial wall unit panel body having its longitudinal ends removably secured to said side walls substantially medially thereof to divide said rectilinear frame into two chambers, said medial wall unit panel body being substantially vertically disposed and in parallel with said end walls, and a second pair of said supporting and nesting members removably affixed to each side of said medial wall unit panel body in opposedly facing parallel relationship to said nesting members on said end walls.

3. The plastic cube or rack defined in claim 1, including two or more plastic intermediate wall units each comprising an intermediate wall unit panel body having its longitudinal ends removably secured to said side walls to divide said rectilinear frame into a plurality of chambers, said intermediate wall unit panel bodies being substantially vertically disposed and in parallel with said end walls and each other, and a pair of said supporting and nesting members being removably affixed to each side of each said intermediate wall unit panel body in opposedly facing parallel relationship to said nesting members on said end walls and next adjacent intermediate wall units.

4. The plastic cube or rack defined in claims 2 or 3, wherein each said medial wall unit and intermediate wall unit is a unitary, integrally formed, molded plastic panel having a substantially planar body.

5. The plastic cube or rack defined in claim 1, wherein each said panel unit is a unitary, integrally formed, molded plastic panel having a substantially planar body and perimetric ribs extending laterally outwardly from one or both sides of said body at its upper, lower and adjacent panel unit side edges.

6. The plastic cube or rack defined in claim 2, wherein each said side wall comprises a side central panel unit having a substantially planar body, a medial wall panel body end receiving section, and ribs projecting laterally outwardly from one or both sides of said side central panel body and defining the upper and lower perimetric edges of said side central panel unit, at least the lower perimetric ribbed edge of said side central panel unit being partially notched and spaced upwardly from a base plane to provide access for insertion thereunder of devices for engaging and lifting said cube.

7. The plastic cube or rack defined in claim 6, including laterally outwardly projecting ribs defining said panel tab receiving sections for said tabs of adjacent panel units at each end of said side central panel unit.

8. The plastic cube or rack defined in claim 7, wherein said tab receiving sections are defined by said laterally outwardly projecting ribs on both sides of said planar body, and said tab receiving sections are offset slightly laterally outwardly to seat said tabs of said adjacent panel units substantially in the plane of said side central panel unit body.

9. The plastic cube or rack defined in claim 8, wherein said ribbed upper and lower perimetric edges of said side central panel unit conjoin with said ribs defining said tab receiving sections in said side central panel unit on both sides of said latter unit planar body.

10. The plastic cube or rack defined in claim 7, wherein each said side wall further comprises intermediate panel units having a substantially planar body, upper, lower and intermediate body portions, said intermediate body portion being slightly offset outwardly with respect to the plane of said upper and lower body portions, the upper edge of said upper body portion and the lower edge of said lower body portion being defined by perimetric ribs extending laterally outwardly from both sides of each said body portion at said edges, and a pair of oppositely directed tabs projecting laterally from each end of said intermediate body portion, said tabs being defined by laterally outwardly projecting perimetric ribs at least on the inner side of said tabs.

11. The plastic cube or rack defined in claim 10, wherein said intermediate panel unit tabs seat within said side central panel unit tab receiving sections, and fastening means removably securing said tabs to said tab receiving sections.

12. The plastic cube or rack defined in claim 10, wherein said side central panel unit is invertible.

13. The plastic cube or rack defined in claim 10, wherein said intermediate panel units are invertible.

14. The plastic cube or rack defined in claim 10, wherein said intermediate panel units are interchangeably attachable to either end of said side central panel unit.

15. The plastic cube or rack defined in claim 11, wherein each said side wall further comprises a side end panel conjoined to the distal end of each said intermediate panel unit, each said side end panel having a substantially planar body, the upper and lower edges of said body being defined by perimetric ribs extending laterally outwardly from both sides of said planar body at said upper and lower edges, and a tab receiving section defined by laterally outwardly projecting ribs for said intermediate panel unit tabs on the end of said side end panel unit body adjacent said intermediate panel unit.

16. The plastic cube or rack defined in claim 15, wherein said tab receiving section of said side end panel is offset slightly laterally outwardly to seat said tab of said adjacent intermediate panel unit substantially in the plane of said side end panel unit body.

17. The plastic cube or rack defined in claim 16, wherein said ribs at said upper and lower edges of said side end panel units conjoin with said ribs or flanges defining said tab receiving sections of said side end panel units.

18. The plastic cube or rack defined in claim 17, wherein each said side end panel unit planar body is provided with a distal edge flange removably secured to one said corner post.

19. The plastic cube or rack defined in claim 18, wherein each said side end panel unit is invertible and interchangeably attachable to either end of said intermediate panel units.

20. The plastic cube or rack defined in claim 18, wherein each said side end panel unit is invertible for use at each end of said side wall.

21. The plastic cube or rack defined in claim 1, wherein each said plastic corner post comprises an integrally formed, unitary, molded body, said body having an end wall directed flange, a right angle panel at the proximal edge of said flange, a second panel offset by said first panel and substantially parallel to said flange, and a side wall directed flange at right angles to said first flange and substantially parallel to said first panel, said body flanges and panels being capped by end plates at the upper and lower ends of said corner post body.

22. The plastic cube or rack defined in claim 21, including fastening means removably securing said end walls and said side walls to said corner posts.

23. The plastic cube or rack defined in claim 1, wherein each said end wall comprises an intermediate panel unit having a substantially planar body, upper, lower and intermediate body portions, said intermediate body portion being slightly offset outwardly with respect to the plane of said upper and lower body portions, the upper edge of said upper body portion and the lower edge of said lower body portion being defined by perimetric ribs extending laterally outwardly from both sides of each said body portion at said edges, and a pair of oppositely directed tabs projecting laterally from each side of said intermediate body portion, said tabs being defined by laterally outwardly projecting perimetric ribs on at least the inner side of said tabs.

24. The plastic cube or rack defined in claim 23, wherein each said end wall further comprises an end-end panel unit conjoined to each end of said intermediate panel unit, each said end-end panel unit having a substantially planar body, the upper and lower edges of said body being defined by perimetric ribs extending laterally outwardly from both sides of said planar body at said upper and lower edges, and a tab receiving section defined by laterally outwardly projecting ribs or flanges for said intermediate panel unit tabs on the end of said side end panel unit body adjacent said intermediate panel unit.

25. The plastic cube or rack defined in claim 24, wherein said tab receiving section of said end-end panel unit is offset slightly laterally outwardly to seat said tab of said adjacent intermediate panel unit substantially in the plane of said end-end panel unit body.

26. The plastic cube or rack defined in claim 25, wherein said ribs at said upper and lower edges of said end-end panel units conjoin with said ribs defining said tab receiving sections of said end-end panel units.

27. The plastic cube or rack defined in claim 26, wherein each said end-end panel unit planar body is provided with a distal edge flange removably secured to one said corner post.

28. The plastic cube or rack defined in claim 27, wherein each said end-end panel unit is invertible and interchangeably attachable to either end of said intermediate panel unit.

29. The plastic cube or rack defined in claim 27, wherein each said end-end panel unit is invertible for use at each end of said end wall.

30. The plastic cube or rack defined in claim 24, wherein said intermediate panel unit in said side walls and end walls are substantially identical and interchangeable one for another.

31. The plastic cube or rack defined in claim 6, wherein said medial wall unit panel body is provided with longitudinally extending, horizontal, aligned and oppositely outwardly directed ribs on each side of said panel body intermediate its upper and lower edges, said load unit supporting and nesting members being removably secured to said panel body adjacent and above said horizontal ribs.

32. The plastic cube or rack defined in claim 31, wherein said medial wall unit panel body is further provided with a lower edge rib extending laterally outwardly from each side of said panel body and defining a lower notched region above a base plane to provide access for insertion thereinto of a device for engaging and lifting said cube.

33. The plastic cube or rack defined in claim 31, wherein said medial wall unit is provided with lateral edge flanges at each lateral end thereof for abutting attachment by fasteners to said side central panel unit receiving section in support of said medial wall unit.

34. The plastic cube or rack defined in claim 1, wherein each said load unit supporting and nesting member comprises means removably attached to said end walls in opposedly facing relationship to support and nest respective ends of said load units within the perimeter of said cube.

35. The plastic cube or rack defined in claim 1, wherein each said load unit supporting and nesting member comprises means removably attached to said side walls in opposedly facing relationship to support and nest respective ends of said load units within the perimeter of said cube.

36. The plastic cube or rack defined in claims 34 or 35, wherein said removably attachable means comprises a horizontally disposed member removably attached in opposedly facing relationship to said end walls or side walls, and components embodied in each said member complementary to the configuration of the ends of said load units to nest and support said ends, and means embodied in said components limiting longitudinal and/or lateral movement and displacement of said load units.

37. The plastic cube or rack defined in claim 21, including an integrally formed, unitary, molded plastic stacking corner cap removably mounted on the upper end plates of and attached by fasteners to the upper end of each said corner post body.

38. The plastic cube or rack defined in claim 37, wherein said stacking corner cap comprises a pair of adjacent outer side walls substantially at right angles to each other, a capping plate at rest upon said corner post body and plate, and skirt portions below said capping plate, a fastener securing at least one said skirt portion to said corner post body.

39. The plastic cube or rack defined in claim 38, wherein said cap outer side walls are provided with upper edge portions angled upwardly outwardly to provide facile entry of cube corner post lower ends of a superposed cube onto said capping plates in stacking relationship.

40. The plastic cube or rack defined in claims 19, 29 or 30, wherein said tabs are rectilinear in planar shape.

41. The plastic cube or rack defined in claims 19, 29 or 30, wherein said tabs are arcuate, circular or oval in planar shape.

42. The plastic cube or rack defined in claims 19, 29 or 30, wherein said tabs have a planar configuration enabling engaged related panel units to form a relatively rigid side wall or end wall sufficiently unitary in structure to support and safely translate load units carried thereby without displacement.

43. The plastic cube or rack defined in claims 34 or 35, wherein each said load unit supporting and nesting member is unitary, integrally formed and molded of a plastic material.

44. The plastic cube or rack defined in claim 1, wherein each said plastic side wall comprises a side central panel unit, a side intermediate panel unit connected to said side control panel unit substantially in the plane and at each end thereof, and a side end panel unit connected to said side intermediate panel unit substantially in the plane and at each end thereof, and each said plastic end wall comprises an end intermediate panel unit, and an end-end panel unit connected to said end intermediate panel unit substantially in the plane and at each end thereof.

45. The plastic cube or rack defined in claim 44, wherein the lower perimetric edges of said side wall and end wall panel units are notched at least partially and spaced upwardly from a base plane to provide a region of access for insertion thereinto of devices for engaging said cube thereunder and lifting said cube from said base plane.

46. The plastic cube or rack defined in claim 6, wherein each said side central panel unit is provided at its highest perimetric surface with a guide lip to assist in stacking a superposed cube into alignment with and upon a lower supporting cube.

47. The plastic cube or rack defined in claim 1, including longitudinally spaced apart transversely disposed members attached to the lower perimetric edges of said walls for support of said cube upon devices placed thereunder for lifting said cube from a base plane.

* * * * *